United States Patent [19]

Ohe et al.

[11] Patent Number: 4,754,284

[45] Date of Patent: Jun. 28, 1988

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 798,023

[22] Filed: Nov. 14, 1985

[30] Foreign Application Priority Data

| | | | |
|---|---|---|---|
| Nov. 15, 1984 | [JP] | Japan | 59-242099 |
| Nov. 26, 1984 | [JP] | Japan | 59-250346 |
| Nov. 28, 1984 | [JP] | Japan | 59-252284 |

[51] Int. Cl.[4] ..... H01Q 1/32; H01Q 7/04

[52] U.S. Cl. ..... 343/712; 343/713; 343/842; 343/866; 343/867

[58] Field of Search ..... 343/711–714, 343/718, 856, 787, 788, 878, 892, 741–742, 904–908, 866, 867, 789, 842

[56] References Cited

U.S. PATENT DOCUMENTS

| | | | |
|---|---|---|---|
| 2,200,574 | 5/1940 | McDonald, Jr. | 343/702 |
| 2,212,253 | 8/1940 | Stief . | |
| 2,404,093 | 7/1946 | Roberts . | |
| 2,481,978 | 9/1949 | Clough | 343/712 |
| 2,520,986 | 9/1950 | Williams | 343/712 |
| 2,575,471 | 11/1951 | Schweiss et al. | 343/712 |
| 2,740,113 | 3/1956 | Hemphill | 343/787 |
| 2,774,811 | 12/1956 | Shanok et al. | 343/711 |
| 2,859,441 | 11/1958 | Rosenbaum | 343/712 |
| 2,950,479 | 8/1960 | Pan | 343/702 |
| 2,971,191 | 2/1961 | Davis | 343/712 |
| 3,007,164 | 10/1961 | Davis . | |
| 3,066,293 | 11/1962 | Davis | 343/767 |
| 3,210,766 | 10/1965 | Parker | 343/743 |
| 3,364,487 | 1/1968 | Maheux | 343/702 |
| 3,611,388 | 10/1971 | Okumura | 343/712 |
| 3,717,876 | 2/1973 | Volkers | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/787 X |
| 3,916,413 | 10/1975 | Davis | 343/856 |
| 3,961,292 | 6/1976 | Davis | 343/712 |
| 3,961,330 | 6/1976 | Davis | 343/712 |
| 3,972,048 | 7/1976 | Davis | 343/711 |
| 4,003,056 | 1/1977 | Davis | 343/713 X |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen, Jr. et al. | 343/712 |
| 4,339,827 | 7/1982 | Torres et al. | 343/748 |
| 4,499,606 | 2/1985 | Rambo | 455/277 |
| 4,506,267 | 3/1985 | Harmuth | 343/744 |
| 4,566,133 | 1/1986 | Rambo | 455/277 |
| 4,633,519 | 12/1986 | Gotoh et al. | 455/277 |

FOREIGN PATENT DOCUMENTS

| | | |
|---|---|---|
| 0181120 | 5/1986 | European Pat. Off. . |
| 0181200 | 5/1986 | European Pat. Off. . |
| 0181765 | 5/1986 | European Pat. Off. . |

(List continued on next page.)

OTHER PUBLICATIONS

Patent Abstracts of Japan, vol. 6, No. 55 (E-101) [933], 10th Apr. 1982; & JP-A-56 168 441 (Nissan Jidosha K.K.) 24-12-1981.

Japanese Pat. Abstract, vol 6, No. 37 E-97 Mar. 6, 1982, 56-156031.

Japanese Pat. Abstract, vol. 7, No. 162 E-187, 7/15/83, 58-70640.

Japanese Pat. Abstract, vol. 7, No. 162 E-187, 7/15/83, 58-70642.

*Primary Examiner*—Marvin L. Nussbaum

*Attorney, Agent, or Firm*—Cushman, Darby & Cushman

[57] ABSTRACT

An automobile antenna system includes a loop antenna disposed along a marginal edge portion of the vehicle body of an automobile for detecting broadcast waves flowing on the vehicle body. A high-frequency pickup which includes the loop antenna is rigidly clamped between a pair of brackets which are secured to the vehicle body through a vehicle body connecting piece. Accordingly, the loop antenna and the end portion of the vehicle body connecting piece on which broadcast waves are concentrated are accurately positioned relative to each other.

9 Claims, 8 Drawing Sheets

FOREIGN PATENT DOCUMENTS

| | | | |
|---|---|---|---|
| 0183523 | 6/1986 | European Pat. Off. . | |
| 889618 | 9/1953 | Fed. Rep. of Germany . | |
| 1131762 | 6/1962 | Fed. Rep. of Germany . | |
| 1949828 | 4/1970 | Fed. Rep. of Germany . | |
| 7015306 | 9/1970 | Fed. Rep. of Germany . | |
| 2701921 | 7/1978 | Fed. Rep. of Germany . | |
| 2745475 | 4/1979 | Fed. Rep. of Germany . | |
| 2821202 | 11/1979 | Fed. Rep. of Germany . | |
| 2425189 | 12/1979 | Fed. Rep. of Germany . | |
| 2733478 | 4/1980 | Fed. Rep. of Germany . | |
| 53-22418 | 7/1978 | Japan . | |
| 53-34826 | 8/1978 | Japan . | |
| 0046617 | 4/1980 | Japan | 343/712 |
| 59-44861 | 3/1984 | Japan . | |
| 129464 | 8/1985 | Japan . | |
| 60-175221 | 8/1985 | Japan . | |

AUTOMOBILE ANTENNA SYSTEM

BACKGROUND OF THE INVENTION

1. Field of the Invention

The present invention relates to an automobile antenna system and, more particularly, to an improved automobile antenna system for effectively detecting broadcast radio waves received by the vehicle body and then transferring detected signals to various receivers located in a vehicle.

b 2. Description of the Prior Art

Antenna systems are indispensable to modern automobiles which must positively receive various broadcast waves for radio, television and telephone, at receivers located in the vehicle compartment. Such antenna systems are very important also for citizen band transceivers.

One of the conventional antenna systems is known as a pole-type antenna which projects outwardly from the vehicle body of an automobile. Although the pole antenna is superior in performance in its own way, it becomes an obstacle in vehicle body styling.

Furthermore, the pole antenna is disadvantageous in that it is subject to damage, mischief or theft and also in that the antenna becomes a cause of noises produced during high-speed driving. For this reason, there has heretofore been a strong demand for eliminating the pole antenna.

In recent years, there has been increased the number of frequency bands for broadcast or communication waves received at automobiles. A plurality of pole antennas are required according to the increased number of frequency bands. This raises other problems in that the plurality of pole antennas may damage the aesthetic appearance of the automobile and in that reception performance may be deteriorated by electrical interference between the antennas.

Efforts have been made to eliminate the pole antenna system or to conceal the same behind the vehicle body. One of the proposals is that a length of antenna wire is applied to the rearwindow glass of an automobile.

Another proposal is that one utilizes surface currents induced by broadcast waves on the vehicle body of an automobile. This apparently provides the most positive and efficient means for receiving broadcast waves. However, experiments show that such a proposal does not provide any satisfactory results.

One of the reasons why surface currents induced by broadcast waves have not been utilized well is that their induced value is not as large as expected. The prior art mainly used surface currents induced in the roof panel of the vehicle body. In spite of this, surface currents a satisfactory level have not been obtained.

Another reason is that surface currents contain very high level noises. Such noises are mainly generated from the engine ignition system and the battery charging regulator and cannot be eliminated unless the engine is stopped. Noises migrating into the vehicle compartment make it impossible to effect any practicably clear reception of broadcast waves.

In such a situation, some proposals have been made to overcome the above problems. One such proposal is disclosed in Japanese Patent Publication Sho No. 53-22418 in which electrical insulation is formed at a portion of the vehicle body on which currents are concentrated, with the currents being detected directly by a sensor between the opposite ends of the insulation.

Although such a construction can detect practicable signals which are superior in S/N ratio, a pickup used therein requires a particular cutout in the vehicle body. This cannot be accepted in the mass-production of automobiles.

Another proposal is shown by Japanese Utility Model Publication Sho No. 53-34826 in which an antenna including a pickup coil for detecting currents in the pillar of a vehicle body is provided. This is advantageous in that the antenna can completely be disposed behind the vehicle body. However, it is not practical that the pickup coil used therein must be located adjacent to the vehicle pillar in a direction perpendicular to the longitudinal axis of the pillar. It also appears that such pickup arrangement cannot obtain any practicable output of the antenna.

As has been described above, the conventional antenna systems are not successful in efficiently detecting currents induced in the vehicle body by broadcast waves.

No effective measure has heretofore been proposed for overcoming the above-described conventional principal problems of providing, particularly, a pickup structure for effectively detecting currents induced in the vehicle body by broadcast waves and a pickup arrangement for obtaining a practicable S/N ratio. The results of various kinds of experiments showed that it might be basically impracticable to use an antenna system utilizing vehicle body currents.

SUMMARY OF THE INVENTION

In view of the above-described problems of the prior art, it is an object of the present invention to provide an improved antenna system for small-sized automobiles which is capable of effectively detecting currents induced in the vehicle body by broadcast waves and then transferring detected signals to various receivers located in the vehicle. The high-frequency pickup of the present invention may be readily mounted in a systematic assembling operation and provides a uniform detecting performance.

It is another object of the present invention to provide an improved antenna system for small-sized automobiles which has an increased output sensitivity and an enlarged range of receivable frequency bands.

To these ends, the present invention provides an antenna system having a high-frequency pickup disposed adjacent to a marginal edge portion of the vehicle body for detecting surface high-frequency currents having a predetermined frequency or more, characterized in that an antenna assembly is previously formed from the high-frequency pickup, brackets and a vehicle body connecting piece, and this antenna assembly is integrally mounted on the vehicle body through the connecting piece which is secured to the vehicle body.

The prior art antenna systems mainly intend to receive AM band waves the wavelength of which are too long to obtain good performance by detecting surface currents induced on the vehicle body. The inventors aimed at this dependency of frequency and made it possible to very efficiently attain the reception of signals from surface currents induced in the vehicle body by broadcast waves which are above FM frequency band (normally, above 50 MHz).

The inventors also aimed at the fact that such surface high-frequency currents are produced at various different locations of the vehicle body in various different densities. Our invention is therefore characterized in that the high-frequency pickup is disposed at a location on the vehicle body which has the minimum level of noise and the maximum density of currents induced by broadcast waves. In one preferred form of the present invention, a location capable of satisfying such a condition is particularly at or near the marginal edge of the vehicle body.

Furthermore, the present invention is characterized by the fact that the high-frequency pickup is disposed along the marginal edge of the vehicle body within a range represented by $12\times10^{-3}$ c/f(m) to positively detect the surface high-frequency currents, where c=the velocity of light and f=carrier frequency of the wave. The pickup for effecting the detection with an increased efficiency may be in the form of a loop antenna for electromagnetically detecting a magnetic flux induced by surface currents on the vehicle body, of electrode means capable of forming an electrostatic capacity between the pickup and a trunk hinge of the vehicle body to electrostatically detect high-frequency signals, or of coil means including a sliding core.

DETAILED DESCRIPTION OF THE PREFERRED EMBODIMENTS

Preferred embodiments of the automobile antenna system according to the present invention will be described hereinunder with reference to the accompanying drawings.

FIGS. 10 through 18 illustrate a process of determining the distribution of high-frequency currents to determine a location at which an antenna system can operate most efficiently on the vehicle body of an automobile.

Figure 10:
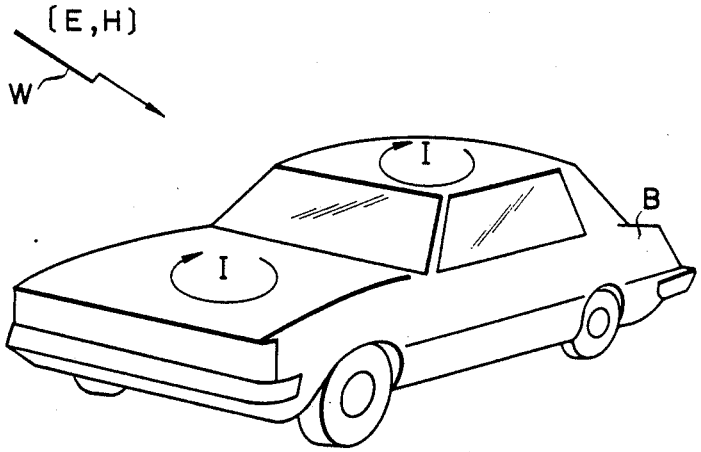
FIG. 10 illustrates surface currents I induced on the vehicle body B by external waves W.

FIG. 10 shows that as external electromagnetic waves W, such as broadcast waves, pass through the vehicle body B of conductive metal, surface currents I are induced at various vehicle locations at levels corresponding to the intensities of electromagnetic waves passing therethrough. The present invention aims at only electromagnetic waves which belong to relatively high frequency bands in excess of 50 MHz, such as FM broadcast waves, television waves and others.

The present invention is characterized by measuring the distribution of surface currents induced on the vehicle body by electromagnetic waves belonging to the above particular wave bands to seek a location on the vehicle body which is higher in surface current density and lower in noise and at which a pickup used in the present invention is to be located.

The distribution of surface currents is determined by a simulation using a computer and also by measuring actual intensites of surface currents at various vehicle locations. In accordance with the present invention, the measurement is carried out by the use of a probe which can operate in accordance with the same principle as that of a high-frequency pickup actually located on the vehicle body at the desired location as will be described hereinafter. Such a probe is moved on the vehicle body throughout the entire surface thereof to measure the level of surface currents at various locations of the vehicle body.

Figure 11:
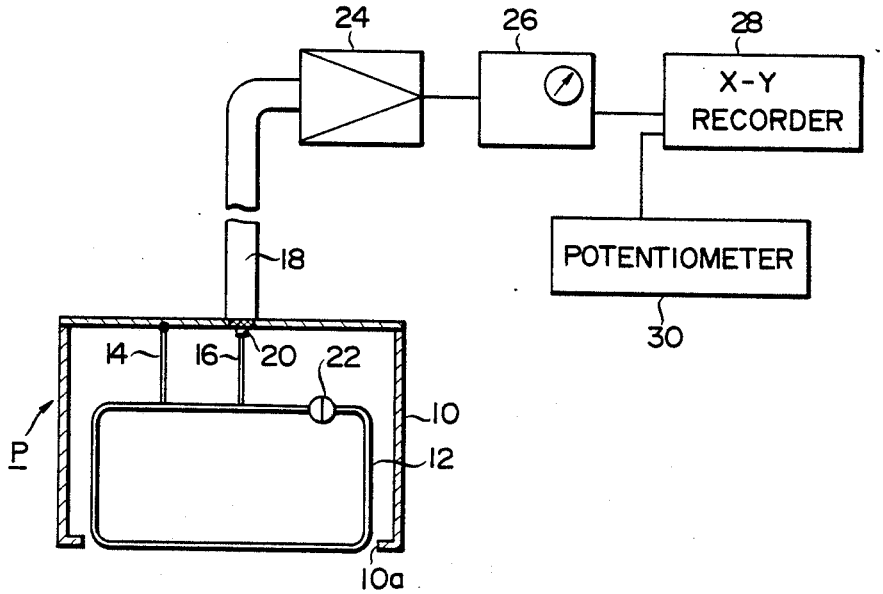
FIG. 11 illustrates a probe for detecting the distribution of surface currents on the vehicle body and having the same construction as that of the high-frequency pickup used in the present invention, and a circuit for processing signals from the probe.

FIG. 11 shows an example of such a probe P which is constructed in accordance with substantially the same principle as that of the high-frequency pickup described hereinafter. The probe P comprises a casing of electrically conductive material 10 for preventing any external electromagnetic waves from migrating into the interior thereof and a loop coil 12 rigidly located within the casing 10. The casing 10 includes an opening **10*a* formed therein through which a portion of the loop coil 12 is externally exposed. The exposed portion of the loop coil 12 is positioned in close proximity with the surface of the vehicle body B to detect a magnetic flux induced by surface currents on the vehicle body B. Another portion of the loop coil 12 is connected with the casing 10 through a short-circuiting line 14. The loop coil 12 further includes an output end 16 connected with a core 20 in a coaxial cable 18. Still another portion of the loop coil 12 includes a capacitor 22 for causing the frequency in the loop coil 12** to resonate relative to the desired frequency to be measured to increase the efficiency of the pickup.

Thus, when the probe P is moved along the surface of the vehicle body B and also angularly rotated at various locations of measurement, the distribution and direction of surface currents can accurately be determined at each of the vehicle locations. In FIG. 11, the output of the probe P is amplified by a high-frequency voltage amplifier 24 with the resulting output voltages being able to be read at a high-frequency voltmeter 26 and also being recorded by an XY recorder 28 to provide the distribution of surface currents at various vehicle locations. The input of the XY recorder 28 receives signals indicative of various vehicle locations from a potentiometer 30 to recognize the value of surface high-frequency current at the corresponding vehicle location.

Figure 12:
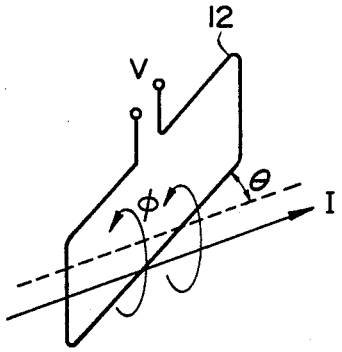
FIG. 12 illustrates the electromagnetic coupling between the surface currents I and the pickup loop antenna.
Figure 13:
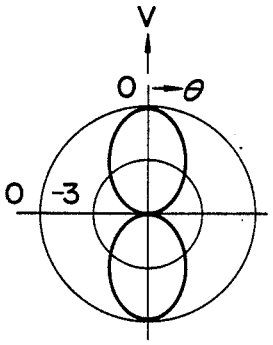
FIG. 13 illustrates the directional pattern of the loop antenna shown in FIG. 12.

FIG. 12 illustrates an angle of deflection 8 between surface high-frequency currents I and the loop coil 12 of said pickup. As shown, a magnetic flux $\phi$ intersects the loop coil 12 to generate a detection voltage V in the loop coil 12. As shown in FIG. 13, when the angle of deflection $\theta$ is equal to zero, that is, the surface currents I are parrallel to the loop coil 12 of the pickup, the maximum voltage can be obtained. In addition, one can know the direction of the surface currents I when the probe P is rotated to obtain the maximum voltage.

Figure 14:
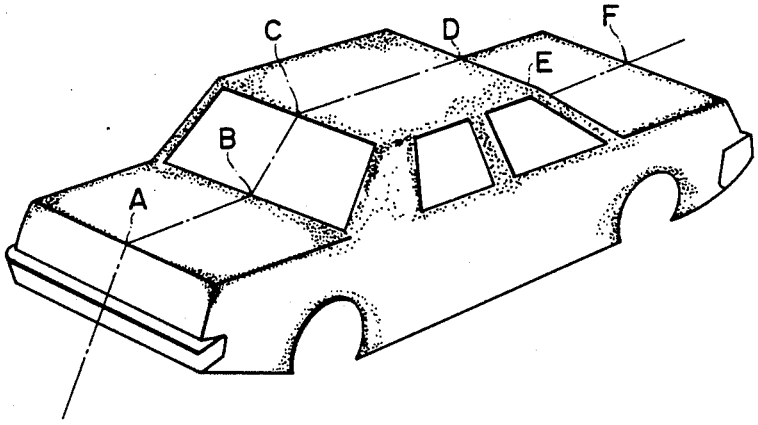
FIG. 14 illustrates the intensity distribution of the surface currents.
Figure 15:
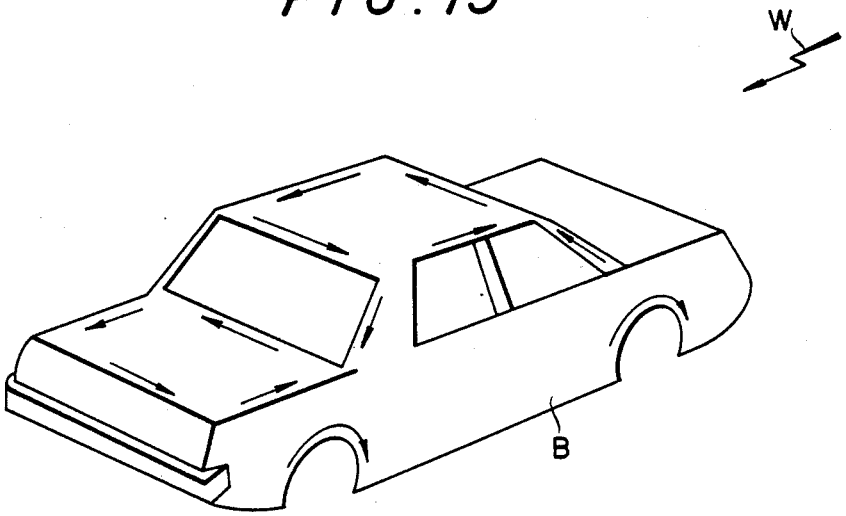
FIG. 15 illustrates the directions of flow of the surface currents.

FIGS. 14 and 15 respectively show the magnitude and direction of surface high-frequency currents induced at various different locations of the vehicle body at the frequency of 80 MHz, the values of which are obtained from the measurements of the probe P and the simulation of the computer. As can be seen from FIG. 15, the distribution of surface currents has higher densities at the marginal edge of the vehicle body and lower densities at the central portions of the flat vehicle panels.

It will also be apparent from FIG. 15 that the surface currents are concentrated in the direction parallel to the marginal edge of the vehicle body or in the direction along the connections of various flat panels.

Figure 17:
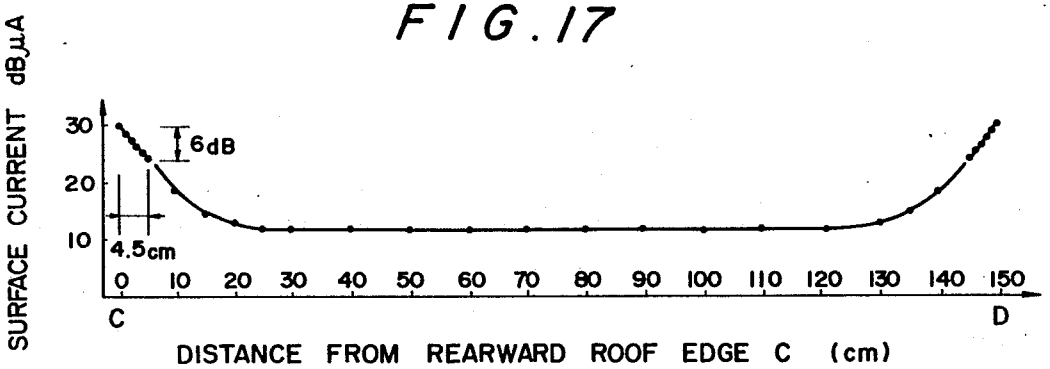
FIGS. 16, 17 and 18 are graphs showing the distribution of surface currents at various locations of the vehicle body shown in FIG. 14 along the longitudinal axis.
Figure 18:
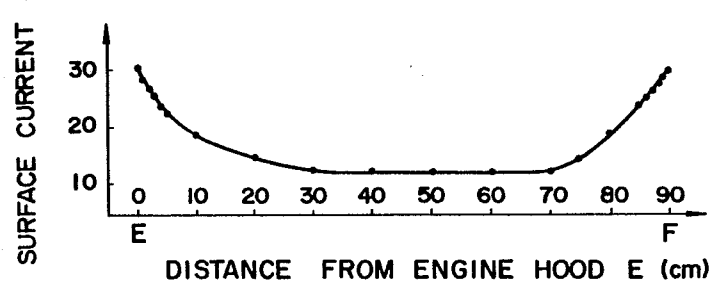
Figure 16:
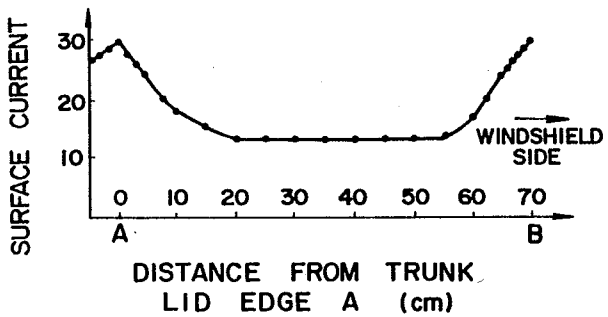

Carefully studying the distribution of surface currents induced at various metallic vehicle portions along the longitudinal axis of the vehicle body as shown in FIG. 14, distribution characteristics can be obtained as shown in FIGS. 16 to 18.

FIG. 16 shows a distribution of surface currents along a trunk lid between two points A and B on said longitudinal axis. As can be seen from this figure, the surface currents become very high levels at these points A and B and decrease toward the central portion of the trunk lid from the opposite points thereof.

Thus, if a high-frequency pickup is disposed near the marginal edge of the trunk lid, the currents concentrating thereon can be detected.

Similarly, FIG. 17 shows the distribution of surface currents along the roof panel of the vehicle body while FIG. 18 shows the distribution of surface currents along the engine hood of the vehicle body. As can be apparent from these figures, very high levels of surface currents are respectively at the marginal edges of the roof panel and engine hood. The value of the surface currents decreases toward the central portion of each of the vehicle sections.

It is thus understood that the pickup should be disposed at or near the marginal edge of each of the vehicle sections to catch broadcast waves with good sensitivity.

In accordance with the present invention, it is also true of course that the high-frequency pickup can similarly be located on pillars and fenders other than the lids and roof panel.

Although the loop antenna of the high-frequency pickup has longitudinally been arranged adjacent to and along the marginal edge of each of the vehicle sections in accordance with the present invention, this loop antenna is preferably positioned within a range determined depending upon the carrier frequency of broadcast waves to be received to obtain very practicable sensitivity.

The distribution of currents shown in FIGS. 16 to 18 relate to vehicle currents induced by the frequency of an FM broadcast wave band which is equal to 80 MHz. The value of surface currents decreases in the direction away from each of the marginal vehicle portions toward the corresponding central portions. Considering the range of decreased currents below 6 dB in which a good sensitivy can actually be obtained, it is understood that it becomes possible if the pickup is positioned within a distance of 4.5 cm from each marginal vehicle portion.

Thus, a satisfactory antenna system can be provided in accordance with the present invention if a high-frequency pickup is arranged within a distance of 4.5 cm away from a marginal vehicle portion for the carrier frequency of 80 MHz.

It is found from the computer's simulation and experimental measurements that the above practicable distance depends upon the carrier frequency used therein. It is also recognized that the distance is decreased as the value of the carrier frequency is increased.

From the fact that the practicable distance of 4.5 cm from the corresponding marginal vehicle portion is inversely proportional to the value of the carrier frequency, good results can be obtained relative to the respective values of the carrier frequency if the high-frequency pickup is spaced away from the marginal edge of a metallic vehicle panel within a distance represented by the following formula:

$$12\times10^{-3}\ c/f(m)$$

where c=the velocity of light and f=the carrier frequency.

In this manner, the present invention provides an improved high-frequency pickup which is located adjacent to the marginal edge of the metallic vehicle body and which is preferably disposed within said range from that marginal edge.

For example, where a carrier frequency equal to 100 MHz is to be received, a high-frequency pickup may be disposed at a vehicle location spaced away from a desired marginal edge of the vehicle body within a distance of 3.6 cm. It will be apparent that as the value of the carrier frequency f is increased, the distance between the high-frequency pickup and the corresponding marginal edge of the vehicle body will be decreased.

Figure 1:
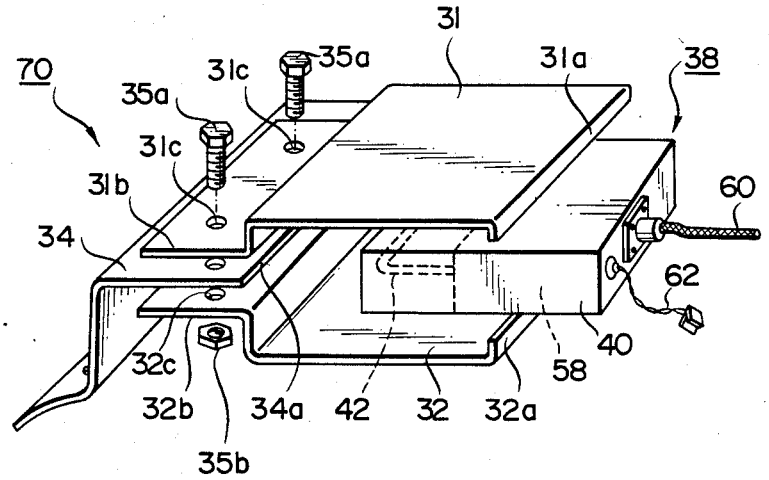
FIG. 1 is an exploded perspective view showing an antenna assembly arranged in accordance with a first preferred embodiment of the automobile antenna system according to the present invention.

FIG. 1 is an exploded perspective view of an antenna assembly in which a high-frequency pickup is clamped.

As shown in FIG. 1, the high-frequency pickup 38 includes a metallic casing 40 for externally shielding a magnetic flux and a loop antenna 42 located within the casing 40. Therefore, this pickup is of an electrmagnetic coupling type similar to the aforementioned probe including its loop coil for measuring the distribution of surface currents on the vehicle body.

The casing 40 of the high-frequency pickup 38 includes circuitry 58 contained therein which is connected with the loop antenna 42. The circuitry 58 includes its internal components such as a pre-amplifier and others for processing detected signals. The resulting high-frequency detection signals are externally taken through a coaxial cable 60 and then processed by the same circuit as that used in measuring the distribution of surface currents. The circuitry 58 receives power and control signals through a coaxial cable 62.

The loop antenna 42 is in the form of a single wound coil which is covered with an insulation such that the coil can be arranged in an electrically insulated relationship with and in contact with the marginal portion of the vehicle body. Thus, the magnetic flux induced by the surface currents can intersect the loop antenna 42 with an increased intensity.

In this embodiment, the high-frequency pickup 38 is clamped at both sides thereof by a pair of brackets 31, 32 each having one end thereof rigidly fastened to the marginal portion of the vehicle body. The brackets 31, 32 are each made from a panel of metal or synthetic resin and are disposed in an opposed relationship with each other. The brackets 31, 32 respectively have hook portions 31*a*, 32, *a* at one end thereof and bent portions 31*b*, 32*b* at the other end which are respectively provided with mounting bores 31*c*, 32*c*. A vehicle body connecting piece 34 is clamped between the bent portions 31*b*, 32*b*. The brackets 31, 32 are integrally secured to the connecting piece 34 by bolts 35*a* and nuts 35*b*. Thus, the high-frequency pickup 38 is rigidly supported such that the portion thereof containing the loop antenna 42 is housed within a space defined between the hook portions 31*a*, 32*a* and the bent portions 31*b*, 32*b* of the brackets 31, 32, with the loop antenna 42 and the end edge 34*a* of the connecting piece 34 opposing each other.

The above high-frequency pickup 38, the brackets 31, 32 and the vehicle body connecting piece 34 constitute in combination an antenna assembly 70 which is integrally mounted on the vehicle body through the connecting piece 34 which is rigidly fastened to the vehicle body. The connecting piece 34 is a separate member obtained by cutting out a portion of the roof panel of the vehicle body on which the antenna assembly 70 is mounted. The connecting piece 34 is mounted at its previous position by employing appropriate fastening means, whereby the high-frequency pickup 38 can be readily and systematically mounted within a relatively narrow space.

Figure 2:
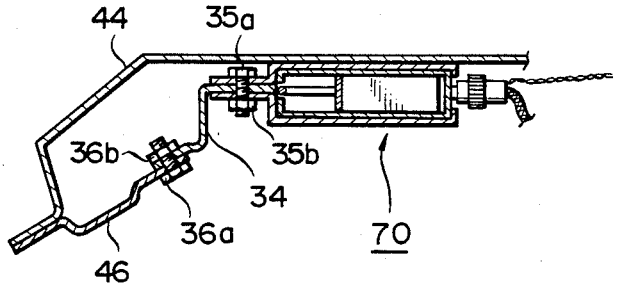
FIG. 2 is a fragmentary sectional view showing the antenna assemby mounted on the roof panel of the vehicle body of an automobile.

FIG. 2 is a fragmentary sectional view showing the antenna assembly 70 mounted on the roof panel of the vehicle body.

The roof panel is composed of an outer panel 44 and an inner panel 46. The antenna assembly 70 is mounted on the roof panel through the vehicle body connecting piece 34 which is rigidly fastened to the inner panel 46 by bolts 36*a* and nuts 36*b*. The bolts 36*a* employed in this case are preferably grounding bolts since it is necessary to ensure the electrical conduction between the inner panel 46 and the vehicle body connecting piece 34. The degree of accuracy in mounting the above-described antenna assembly 70 can be adjusted as desired by means of the bolts 36*a* and the nuts 36*b*. In this way, it is possible to minimize possible errors or variations in mounting the antenna assembly 70 and to carry out a systematic assembling operation.

Accordingly, it is possible to positively detect FM broadcast waves from surface currents flowing along the marginal edge of the vehicle body. As will be clear from FIG. 15, which illustrates the directions of flow of the surface currents, the surface currents flow along the marginal edges of the vehicle body. In this embodiment, therefore, the loop antenna 42 is longitudinally disposed along a marginal edge (e.g., the vehicle body connecting piece 34) of the vehicle body.

Thus, according to this embodiment of the present invention, surface currents flowing along the marginal edges of the vehicle body, particularly, the marginal edge of the roof panel are electromagnetically detected by the high-frequency pickup, thereby making it possible to positively receive broadcast waves belonging to high-frequency bands without externally exposing any portion of the antenna system. Accordingly, the present invention is extremely useful as an automobile antenna system.

In the above-described embodiment, an electromagnetic coupling type pickup is employed as the high-frequency pickup. However, since the feature of the present invention resides in obtaining an antenna system which receives external waves by detecting surface currents flowing along the marginal edge of the vehicle body, it can similarly utilize an electrostatic coupling type high-frequency pickup.

In the case of an electrostatic coupling type high-frequency pickup, a detecting electrode is longitudinally disposed along the marginal edge of the vehicle sheet metal shown in the aforementioned figures through an air gap or insulation, and surface high-frequency currents are fetched by the detecting electrode through an electrostatic capacity formed between the detecting electrode and the surface of the vehicle, whereby it is possible to fetch high-frequency signals in the desired frequency band.

Furthermore, the present invention may use a high-frequency pickup of a coil type having a ferrite core which is arranged so that the core will be parallel to and in close proximity with the marginal edge of a rearwindow frame, inner header panel or fender. A coil wound about the ferrite core is used to fetch the induced currents.

Figure 3:
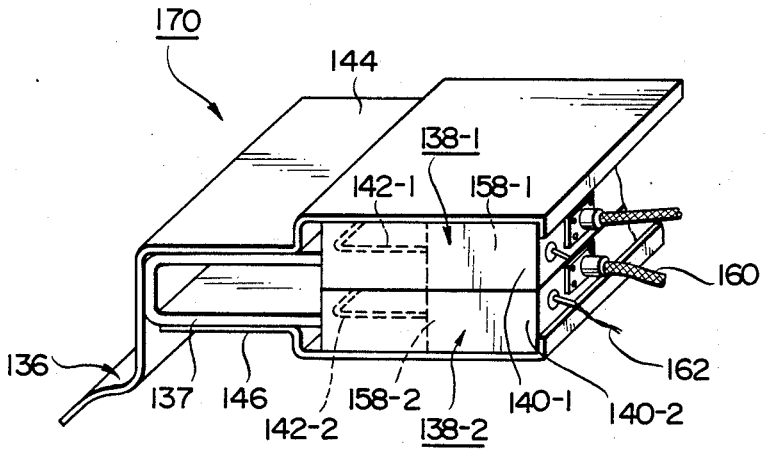
FIG. 3 is a schematically perspective view showing an antenna assemby arranged in accordance with a second preferred embodiment of the automobile antenna system according to the present invention which has two pickups.
Figure 4:
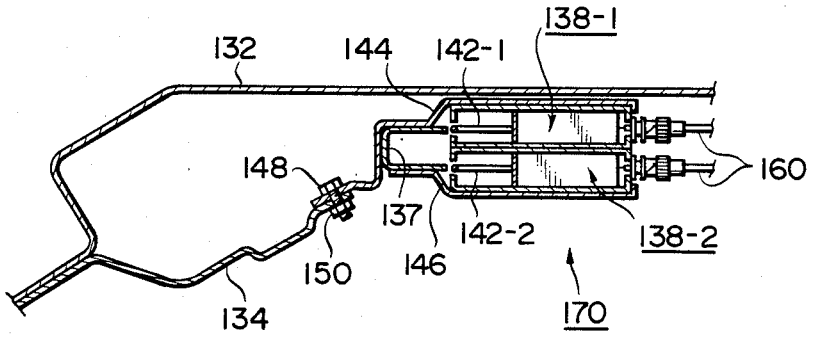
FIG. 4 is a fragmentary sectional view showing the antenna assembly illustrated in FIG. 3, the antenna assembly being mounted on the roof panel of the vehicle body of an automobile.

FIGS. 3 and 4 show in combination a second embodiment in which an antenna assembly having two high-frequency pickups clamped therein is mounted on the inner panel of the roof panel.

In these figures, the metallic roof panel is composed of an outer panel 132 and an inner panel 134. In this embodiment, a portion of the inner panel 134 is cut out, and an antenna assembly 170 is mounted in the cut portion of the inner panel 134.

As shown in FIG. 3 in detail, the antenna assembly 170 in this embodiment comprises two high-frequency pickups 138-1, 138-2, a bracket body 136 and a current detecting piece 137. The high-fequency pickups 138-1, 138-2 respectively include metallic casings 140-1, 140-2 for shielding external electromagnetic waves, and loop antennas 142-1, 142-2 located within the respective casings 140-1, 140-2. Thus, the pickups 138-1, 138-2 form electromagnetic coupling type pickups similar to the aforementioned probe including its loop coil for measuring the distribution of surface currents on the vehicle body.

The casings 140-1, 140-2 of the high-frequency pickups 138-1, 138-2 respectively include circuitries 158-1, 158-2 located therein which are respectively connected with the loop antennas 142-1, 142-2. The circuitries 158-1, 158-2 include their respective internal components such as pre-amplifiers and others for processing detected signals. The resulting high-frequency detection signals are externally taken through coaxial cables 160 and then processed by the same circuits as that used in measuring the distribution of surface currents. The circuitries 158-1, 158-2 receive power and control singals through coaxial cables 162.

Each of the loop antennas 142-1, 142-2 is in the form of a single wound coil which is covered with an insulation such that the coil can be arranged in an electrically insulated relationship with and in contact with the marginal edge of the vehicle body of an automobile. Thus, the magnetic flux induced by the surface currents can intersect the loop antennas 142-1, 142-2 with an increased intensity.

Figure 5:
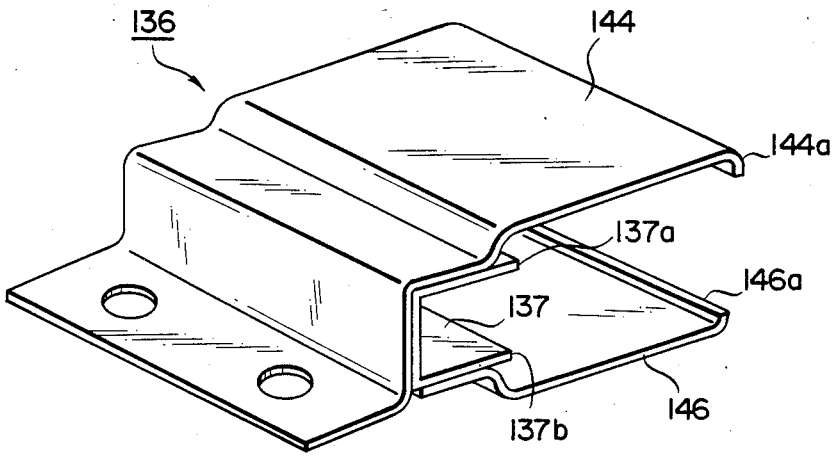
FIG. 5 is a perspective view showing the positional relationship between the bracket member body and the current detecting piece provided inside of the bracket body illustrated in FIGS. 3 and 4 in their assembled state.

The bracket body 136 and the current detecting piece 137 are illustrated in FIG. 5 in detail. The bracket body 136 includes the vehicle body connecting piece 144 which is cut out from the inner panel 134 of the roof panel of the vehicle body, and a support member 146 which opposes the connecting piece 144 and which rigidly clamps the two pickups 138-1, 138-2 in the area defined between the same and the connecting piece 144. The current detecting piece 137 with a U-shaped cross-section is provided inside the bracket body 136. A hook portion 114*a* is formed at one end of the vehicle body connecting piece 144, and a hook portion 146*a* at one end of the support member 146. The two high-frequency pickups 138-1, 138-2 are clamped between the vehicle body connecting piece 144 and the support member 146 such that they are pressed against the current detecting piece 137 by the hook portions 144*a*, 146*a*. In this case, the loop antennas 142-1, 142-2 of the high-frequency pickups 138-1, 138-2 are positioned in an opposed relationship with end edges 137*a*, 137*b* of the current detecting piece 137. In this state, the vehicle body connecting piece 144, the current detecting piece 137 and the support member 146 are welded or bonded together in one unit.

The above constitutent members of the bracket body 136 may be fixed together by fastening means such as bolts. Further, although two high-frequency pickups 138-1, 138-2 are clamped by the bracket body 136 in this embodiment, three or more high-frequency pickups may be clamped according to need.

The thus completed antenna assembly 170 is rigidly fastened to the inner panel 134 of the roof panel of the vehicle body by bolts 148 and nuts 150, as illustrated in FIG. 4.

In consequence, the degree of accuray in mounting the antenna assembly 170 can be adjusted as desired by means of the bolts 148 and the nuts 150.

In this manner, it is possible to positively detect FM broadcast waves from surface currents flowing along the marginal edge of the vehicle body. As will be clear from FIG. 15, the surface currents flow along the marginal edge of the vehicle body. In this embodiment, therefore, the loop antennas 142-1, 142-2 are longitudinally disposed along the corresponding end edges 137*a*, 137*b* of the current detecting piece 137.

Thus, it is possible, according to this embodiment, to positively receive broadcast waves in high-frequency bands without externally exposing any portion of the antenna system by electromagnetically detecting surface currents flowing along the marginal edges of the vehicle tody, particularly, the marginal edge of the roof panel by the high-frequency pickups. Further, the currents flowing along the end edges 137*a*, 137*b* of the current detecting piece 137 are detected and added together to obtain a two-fold output, so that the output sensitivity is increased by 6 dB. Furthermore, if the pickups 138-1, 138-2 are adapted for detecting broadcast waves belonging to frequency bands which are different from each other, it becomes possible to enlarge the range of receivable frequency bands as a whole.

Figure 6:
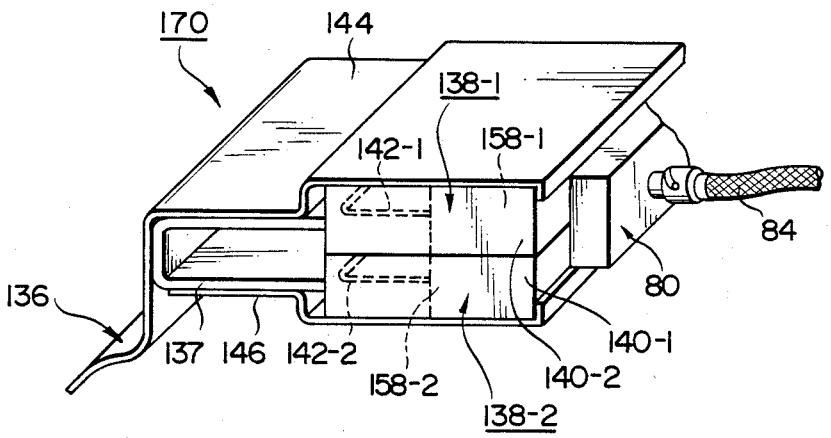
FIG. 6 is a schematically perspective view showing an antenna assembly arranged in accordance with a third preferred embodiment of the automobile antenna system according to the present invention in which the respective outputs of two pickups are synthesized.
Figure 7:
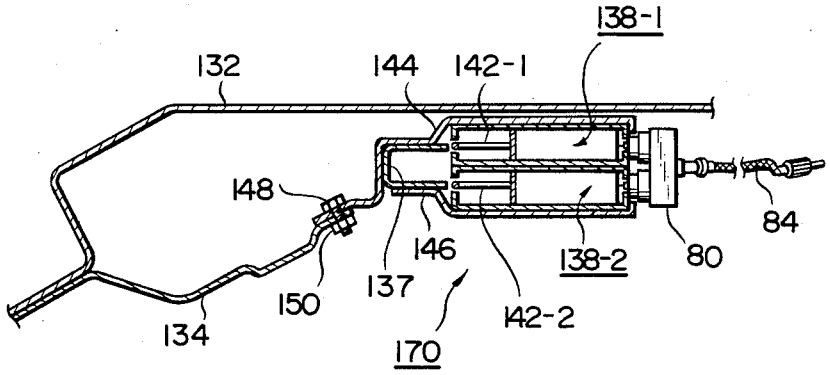
FIG. 7 is a fragmentary sectional view showing the antenna assembly illustrated in FIG. 6, the antenna assembly being mounted on the roof panel of the vehicle body of an automobile.
Figure 8:
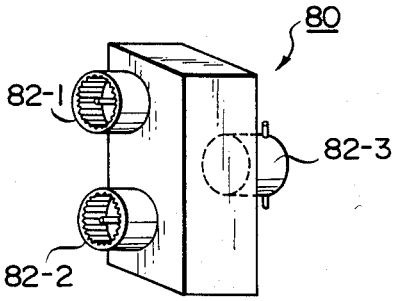
FIGS. 8 and 9 illustrate the external appearance of the synthesizer shown in FIGS. 6 and 7.

FIGS. 6, 7 and 8 show in combination a third embodiment which is similar to that shown in FIGS. 3 to 5.

The high-frequency detection signals respectively obtained from the two pickups 138-1, 138-2 are input to a synthesizer 80 provided at the rear (the output connector side) of the pickups 138-1, 138-2. In this embodiment, the synthesizer 80 adds together the output signals from the two high-frequency pickups 138-1, 138-2. As shown in FIG. 8, the synthesizer 80 has two connectors 82-1, 82-2 on its input side which are respectively connected with high-frequency pickups 138-1, 138-2 and one connector 82-3 on its output side. Thus, two signals are added together by the synthesizer 80, whereby the output is doubled, that is, the output sensitivity is increased by 6 dB, without occurrence of any phase interference.

More specifically, it is possible to ignore any phase difference between the output voltages of the high-frequency pickups 138-1, 138-2 when the distance between their mounting positions is much smaller than the wavelength of broadcast waves to be received, or when their receiving frequency bands are separate from each other to such an extent that there is no influence on their sensitivity characteristics.

Figure 9:
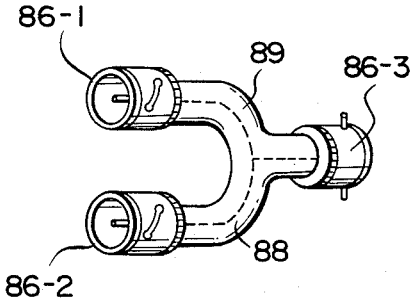

Further, the provision of the synthesizer 80 makes it possible to combine together two signals respectively output from the high-frequency pickups 138-1, 138-2, and a single coaxial cable 84 is led out from the output side of the synthesizer 80 and connected with receivers located in the vehicle, which improves the efficiency of wiring operation. It is to be noted that the synthesizer 80 shown in FIG. 8 is not necessarily limited to that configuration, and it is also possible to employ a means for combining two output signals in which, as shown in FIG. 9, connectors 86-1, 86-2 and 86-3 are directly connected with each other by a core 89 in a coaxial cable 88.

It will be apparent from the foregoing that in accordance with the present invention, the antenna system can receive broadcast waves belonging to relatively high frequency bands such as FM frequency bands or more by detecting the surface high-frequency currents induced particularly at the marginal edge of the vehicle body by its high-frequency pickup. Further, an antenna assembly is previously formed from the pickup, brackets and a vehicle connecting piece, and this antenna assembly is rigidly fastened to the marginal edge of the vehicle body. Therefore, the antenna system can effect its good detection with high density and with less noise. Further, it is possible to mount the high-frequency pickup in a systematic assembling operation and minimize variations in output of the pickup.

In one preferred form of the present invention, the high-frequency surface currents induced particularly at the marginal edge of the vehicle body are detected by a plurality of high-frequency pickups, while an antenna assemby including the pickups is previously formed, and this antenna assembly is secured to the vehicle body. It is therefore possible for the antenna system to effect a good detection with high density and with less noise. In addition, it is also possible to mount the high-frequency pickups in a systematic assembling operation and minimize variations in output of the pickups.

In another preferred form of the present invention, a signal synthesizer is provided for a plurality of high-frequency pickups, and a single output coaxial cable is led out from the synthesizer, whereby the efficiency of mounting and wiring operation is increased.

What is claimed is:

1. An automobile antenna system comprising:

high-frequency pickup means longitudinally disposed along and in close proximity with a marginal edge portion of the vehicle body of an automobile, the marginal edge portion being a peripheral edge portion of a metal plate which forms the vehicle body, said pickup means being provided for detecting high-frequency surface currents which are induced by broadcast waves on the vehicle body and concentrated on the marginal edge portion of the vehicle body;

a pair of brackets clamping said high-frequency pickup means therebetween; and a vehicle body connecting piece which is cut out from the vehicle body having one end to which said pair of brackets clamping said high-frequency pickup means therebetween are secured and having the other end secured to the marginal edge portion of the vehicle body such that said pickup means oppposes said marginal edge portion of the vehicle body, wherein said high-frequency pickup means, said brackets and said vehicle body connecting piece are assembled together to constitute an antenna assembly which is integrally mounted on the vehicle body through said connecting piece which is secured to said vehicle body.

2. An automobile antenna system as defined in claim 1, further comprising circuit means for processing a signal detected by said pickup means and wherein said high-frequency pickup means includes a loop antenna in the form of a single wound coil provided within a metallic casing together with said circuit means, said casing being rigidly clamped between said pair of brackets.

3. An automobile antenna system as defined in claim 2, wherein each of said brackets has a hook portion at one end thereof and a bent portion at the other end, said bent portion having a mounting bore, said brackets being disposed in an opposed relationship with each other, the casing containing said pickup means being supported between said hook portions and said bent portions, and one end of said vehicle body connecting piece being rigidly clamped between said bent portions.

4. An automobile antenna system as defined in any one of claims 1 to 3, wherein said vehicle body connecting piece is constituted by a portion of the roof panel of the vehicle body.

5. An automobile antenna system as defined in claim 1, wherein said high-frequency pickup means is constituted by an electrostatic coupling type pickup.

6. An automobile antenna system comprising:

at least two high-frequency pickup means longitudinally disposed along and in close proximity with a marginal edge portion of the vehicle body of an automobile, the marginal edge portion being a peripheral edge portion of a metal plate which forms the vehicle body, said pickup means being provided for detecting high-frequency surface currents which are induced by broadcast waves on the vehicle body and concentrated on the marginal edge portion of the vehicle body;

bracket body means including a vehicle body connecting piece cut out from the vehicle body, having one end thereof rigidly fastened to the marginal edge portion of the vehicle body and a support member rigidly fastened at the other end of the vehicle body connecting piece for clamping said at least two high-frequency pickup means; and a current detecting piece providing inside said bracket body means, electrically connected at one end to the marginal edge portion of the vehicle body, and which opposes at respective opposite ends respective loop antennas of said at least two high-frequency pickup means, wherein said high-frequency pickup means, said bracket body means and said current detecting piece are assembled together to constitute an antenna assembly which is integrally mounted on the vehicle body through said vehicle body connecting piece which is secured to said vehicle body.

7. An automobile antenna system as defined in claim 6, wherein said current detecting piece is constituted by a U-shaped metal piece, said vehicle body connecting piece and said support member being respectively secured to two opposing sides of said current detecting piece, and said high-frequency pickup means being rigidly clamped between said vehicle body connecting piece and said support member each having a hook portion at one end thereof.

8. An automobile antenna system as defined in either one of claims 6 and 7, wherein said vehicle body connecting piece is cut out from the inner panel of the roof panel of the vehicle body.

9. An automobile antenna system comprising:

at least two high-frequency pickup means longitudinally disposed along and in close proximity with a marginal edge portion of the vehicle body of an automobile, the marginal edge portion being a peripheral edge portion of a metal plate which forms the vehicle body, said pickup means being provided for detecting high-frequency surface currents which are induced by broardcast waves on the vehicle body and concentrated on the marginal edge portion of the vehicle body;

bracket body means including a vehicle body connecting piece cut out from the vehicle body, having one end thereof rigidly fastened to the marginal edge portion of the vehicle body, and a support member, rigidly fastened at the other end of the vehicle body connecting piece, for clamping said at least two high-frequency pickup means;

a current detecting piece provided inside said bracket body means, electrically connected at one end to the marginal edge portion of the vehicle body, and which opposes at respective opposite ends respective loop antennas of said at least two high-frequency pickup means; and combining means for receiving signals respectively output from said high-frequency pickup means for combining said signals, wherein said high-frequency pickup means, said bracket body means, said current detecting piece and said combining means are assembled together to constitute an antenna assembly, and a single output cable is led out from said combining means.

* * * * *